US006308955B1

(12) United States Patent
Slatter

(10) Patent No.: US 6,308,955 B1
(45) Date of Patent: Oct. 30, 2001

(54) MATHEMATICAL BOARDGAME

(76) Inventor: Narelle Anne Slatter, 28 Freeland Way, Perth, W.A. (AU), 6054

( * ) Notice: Subject to any disclaimer, the term of this patent is extended or adjusted under 35 U.S.C. 154(b) by 0 days.

(21) Appl. No.: 09/381,116

(22) PCT Filed: Jan. 28, 1998

(86) PCT No.: PCT/AU98/00045

§ 371 Date: Sep. 16, 1999

§ 102(e) Date: Sep. 16, 1999

(87) PCT Pub. No.: WO99/38584

PCT Pub. Date: Aug. 5, 1999

(51) Int. Cl.[7] ..... A63F 3/00
(52) U.S. Cl. ..... 273/243; 273/292; 273/430
(58) Field of Search ..... 273/236, 243, 273/292, 430, 431

(56) References Cited

U.S. PATENT DOCUMENTS 4,273,337 * 6/1981 Carrera .
4,515,372 * 5/1985 Gonzales .
4,984,805 * 1/1991 Medlock .
5,244,391 * 9/1993 Bryant .
5,679,002 * 10/1997 Scelzo .
5,813,671 * 9/1998 Barratt .
6,019,370 * 2/2000 Morris .

* cited by examiner

*Primary Examiner*—Benjamin H. Layno
*Assistant Examiner*—Vishu Mendiratta

(57) ABSTRACT

A mathematical board game for 2 to 8 players, invented primarily for beginners and individuals struggling with the four basic formats of mathematics. The banker is allocated by use of a spinner, players then determine who moves first, by use of this spinner, and in which of the four formats they will play, these are: Subtraction, Multiplication, Addition and Division. Players then move by taking four steps. (1) Taking a question card out of the appropriate question bag; (2) Working out the relevant sum; (3) Looking up the answer on the correlating Answer Value Chart, which converts the answer of the mathematical sum to a given value, which is a number; (4) Moving that number of spaces on the board and receiving that amount of money from the bank. The board's defined numbered travel path is from 1 to 144 spaces. Some spaces are marked with various symbols, which require various actions that affect the players. Players move their playing piece horizontally from left to right, right to left, to a Finish Award they have nominated, which conveniently gives players the choice of a quick, medium or lengthy game. The Answer Value Charts enables the three sections; Sub-Junior, Junior and Senior—players of varying ages and abilities, to play together, with an equal chance of achieving equal values. The winner is the player with the most money on completion, thereby winning by chance not academically. Other known facts incorporated, enable every player to attain the correct answers, while facilitating their personal learning styles.

4 Claims, 6 Drawing Sheets

D
A
M
$
1
D
A
M
$
1
D
A
M
$
1

MATHEMATICAL BOARDGAME

FIELD OF THE INVENTION

This present invention pertains to a mathematical board game for 2–8 players. Its primary aim is to facilitate knowledge of the four basic formats of mathematics, concentrating on these mainly. They are: subtraction, multiplication, addition and division.

DESCRIPTION OF THE PRIOR ART

Many amazingly ingenious board games prevail in the prior art, all fulfilling a need in their own niche. One area amongst others no prior art addresses, are the feelings of inadequacy—embarrassment, of those young or old alike, who are mathematically-challenged. I am aware of the following patents and my understanding of the workings of the disclosed inventions are as follows.

The patent to Medlock, U.S. Pat. No. 4,984,805, refers to timing devices for timing answers given. Moving out of turn and incorrect answers—resulting in penalties. This prior art covers multiple categories—not concentrating solely on mathematics. No monies or award ribbons are used as an incentive for achievement. It is not a positive game for mathematically-challenged players. The random selector device in this prior art is ingeniously interchangeable, to cover multiple categories, this is its only function. Players move forward only if answer is correct. Question and Answer cards are handled by one player, along with cards of predetermined good and bad luck, they are randomly mixed in with question and answer cards. A great game for competent players, it is not devised to help players struggling with the basic formats of mathematics.

The patent to Carerra, U.S. Pat. No. 4,273,337, designates a random selector device, which enables players to determine which one of three stacks of cards on the board they must take a question card from. These question cards are pertaining to sex-education. In this prior art, the only other function of the random selector device is when players land on set playing spaces marked spinner and double spinner, taking one or two extra turns if correct, if incorrect penalized singly or doubly moving backwards. In this prior art, players move forward a predetermined number of spaces only if they answer correctly. Players moves are determined quite differently to this present art.

The patent to Bryant, U.S. Pat. No. 5,244,391, has in the prior art a random selector device affixed to the board and question cards, the scope of these quite different to Carerra and Medlock aforementioned and to this instant invention. The prior art of Bryant is all geared towards the subject of illegal chemical substances, warning/educating players.

The patent to Morris, U.S. Pat. No. 6,019,370. This prior art relates to multiple categories. There is a gambling aspect not always appreciated, but for those that do appreciate it, a lot of fun. In this prior art, movement by players, questions and subject matter categories are all selected by random die/dice casts. Players answer questions and move along the travel path, only if answer correctly corresponds to answer in a question and answer book. The spaces they move is determined by the total sum of their dice cast, plus if desired a predetermined number of additional spaces.

The patent to Scelzo, U.S. Pat. No. 5,679,002, is a mathematical board game, where once again players are penalized for incorrect answers and many other multiple differences. Fractions are included in this prior art, a difficult area of mathematics for players unskilled in multiplication, as they could not readily work out the common denominator.

The patent to Barrat, U.S. Pat. No. 5,813,671. This prior art makes use of money and question cards. Money is used to pay bills and is not awarded as an incentive for each space a player moves forward. Questions are trivia-type and the like. It is geared towards learning about different geographical places/natural and man-made attractions and places to lodge.

The patent to Gonzales, U.S. Pat. No. 4,515,372, describes a game in the prior art of chance solely. It is not a game based on multiple, or singular educational categories. The random selector device is quite intricately designed in the manner of a spinning top; is used to determine monies to be paid, which goes to kitty and money to be collected if it comes up jackpot; it may require players to pick up cards. It appears no question cards are used in this prior art, only cards of predetermined good/bad luck consequences. It is understood monies paid or collected depend on a die cast to determine amount—when players land on pay or pay double, or collect or collect double.

None of the aforementioned prior arts, either singularly or combined describe this instant invention: the players can start together and be on equal levels because of the Answer Value Charts, mode of movement by players is unique, it concentrates on one category—basic maths, utilizes positive methods—in this present art all these various components and methods are used in unique combinations or singularly in new and improved ways. Unlike any other prior art, this is the first novel and improved art dedicated and invented for individuals that struggle with the basics of mathematics, yet enables other players to be entertained, irrespective of mathematical abilities or age differences. In this present art they can all play together with an equal chance of achieving equal values. Hereafter these novel aspects and functions will be further detailed. This present art enables players to gain confidence in their mathematical prowess, and will provide a solid foundation upon which they can build, as this confidence grows.

SUMMARY OF THE INVENTION

The first objective of the present invention was to provide a new and improved mathematical-teaching board game. Considering the prior art, it is apparent that there is a real need for a board game devoted to helping those, young and old alike, that struggle with the basic 'building blocks' of mathematics. Those basics being: subtraction, multiplication, addition and division.

A second objective was to do so in a positive manner that is helpful and constructive as well as motivational, whilst incorporating well-known learning styles, to aid memory and recall abilities, particularly in the area of multiplication and division. Then to set all this into a board game that does not make a player feel inadequate or embarrassed about their mathematical 'standing'.

A third objective was to fulfil the obvious challenge of making it exciting and stimulating and an even more challenging task, to use new and improved means so that players win by chance, rather than mathematical ability.

A fourth objective was to design the game so that players of varying ages and abilities could play together, with an equal chance of attaining equal values. With all the above in mind, this game was designed to generate areas of chance, to avail means of rewarding players and to fulfil the aforementioned objectives.

In accordance with the first objective of this present invention a random selector device was deployed (hereafter referred to as the spinner) and designed to designate four games of play (hereafter referred to as formats) these formats being the basic 'building blocks' of mathematics, they are: subtraction, multiplication, addition and division. The spinner has other uses—see method of play.

In accordance with the second objective of this present invention, it has been designed specifically to utilize a multiplicity of motivational, positive not penalizing, means of learning, using new and improved methods and components. Award Ribbons, personal Award Boards, Answer Value Charts, Money, personal Money Trays, allowing players to facilitate the three known learning styles to attain the correct answers, (as they are 'known styles' they are not detailed herein, it's only mentioned—every player is given the time and means to attain the correct answers.) this gives them a helpful constructive way of building memory-recall abilities. Players also have the advantage of playing in three Divisions (hereinafter referred to as Sections, so as to avoid confusion of mathematical—division and division of age/ability). These sections are: Sub-Junior, Junior and Senior, each with mathematical sums to suit the age/ability levels. For very competent players all sections are relatively easy, but it utilizes chance to make this an exciting game, whilst being helpful for those that are mathematically-challenged.

In accordance with the third objective of this present invention, new and improved means of moving players along the game board from the start to the nominated finish point were implemented. All players move by performing four short steps: (1) Randomly selecting a question card from the appropriate question bag. (2) Working out the relevant mathematical sum, (or following the three known styles to attain the correct answer). (3) Looking up the answer on the relevant Answer Value Chart—which gives the answer a predetermined value—that value being a number. (4) Moving that number of spaces on the board in numerical sequence and receiving that amount of money from the bank. Furthermore in accordance with the third objective multiple marked spaces on the game board provide a variety of exciting actions with correlating cards containing predetermined chance factors as well as awards. These being: $.M.A.D. spaces, Question spaces, In the Money, In the Red spaces, and Award spaces. Furthermore in accordance with the third objective, players win by chance, not mathematical ability. This is achieved by allowing every player the time and means to attain the correct answers and stating that the Winner is the player with the most money upon completion of the game.

In accordance with the fourth objective of this present invention, Answer Value Charts are a new and improved aspect—predetermined answers correlate with predetermined values—which are numbers. All values in each format of each section when added, produce the same total. (Values determine the number of spaces moved and the amount of money received from the bank.) This new and improved present invention allows all players regardless of age or mathematical skills to play together with an equal chance of attaining equal values. The spinner is uniquely designed to achieve a lot of functions singularly or plays one role within a set of roles. An important positive aspect is that all players get to the Finish Award, this also facilitates a greater coverage of mathematical sums.

Hitherto, the new and improved aspects of this present invention have been outlined rather broadly to gain an understanding of how this present invention solves problematic areas in the prior art—keeping in mind, the present art is intended to help those that are mathematically-challenged by the four basic formats of mathematics. This summary is not intended to limit in any aspect this present invention. For an even more detailed description of its operative advantages and improved objectives, hereafter follows preferred embodiments which are detailed and accompanying drawings.

DESCRIPTION OF THE PREFERRED EMBODIMENTS

Figure 1:
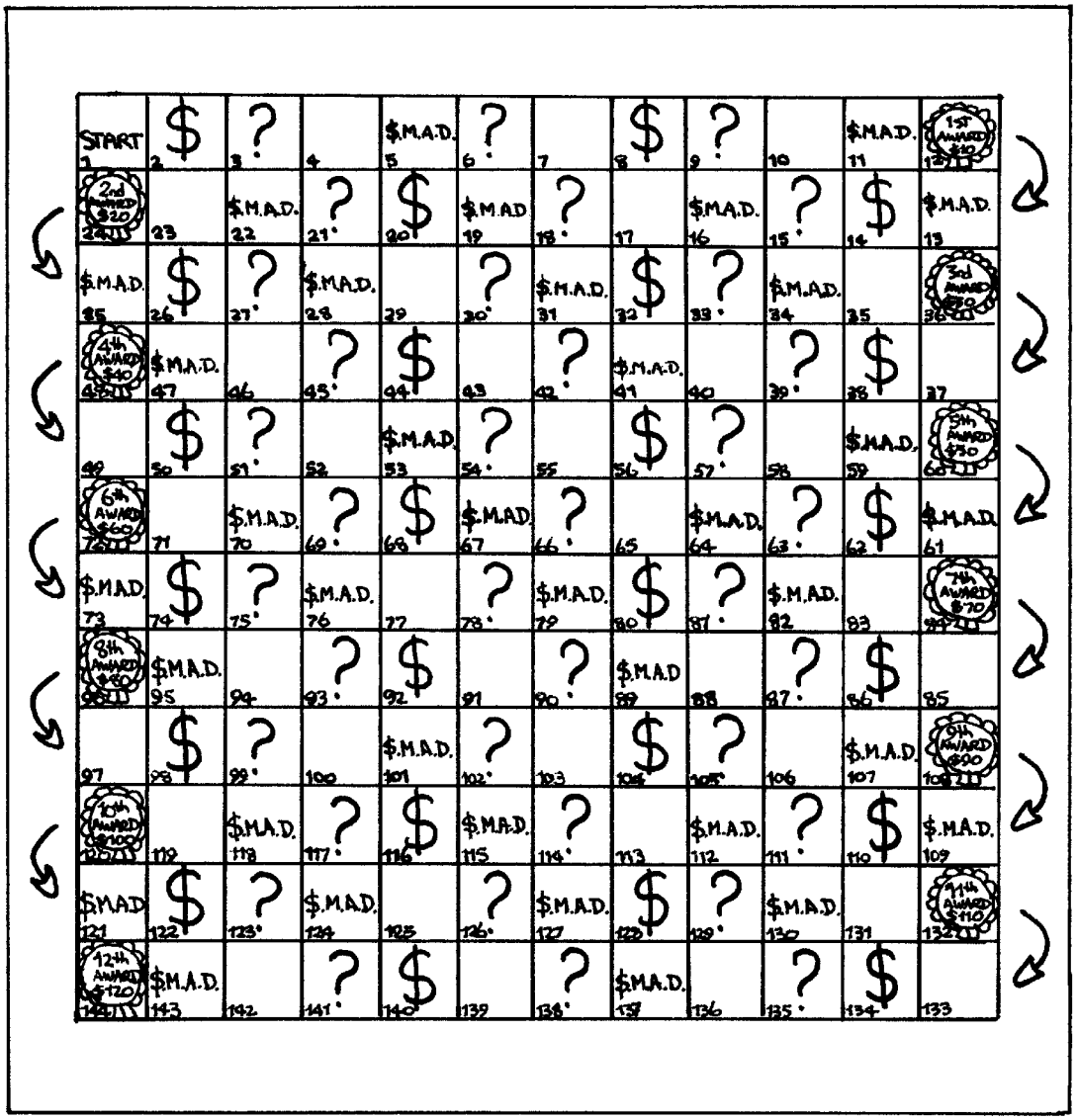
FIG. 1 is a plan view of the preferred layout of the present game board, used in accordance with this present invention.

Referring now to the drawings of components used in accordance with this present invention, they are shown in FIGS. 1–13, and are used in various combinations or singularly in this new and improved mathematical board game.

Figure 7A:
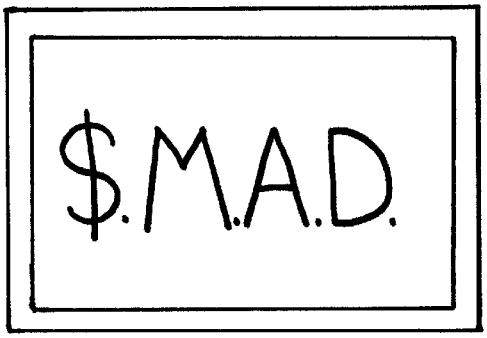
FIG. 7 shows a top and bottom plan view of an exemplary $.M.A.D. Card, used in accordance with this present invention.
Figure 7B:
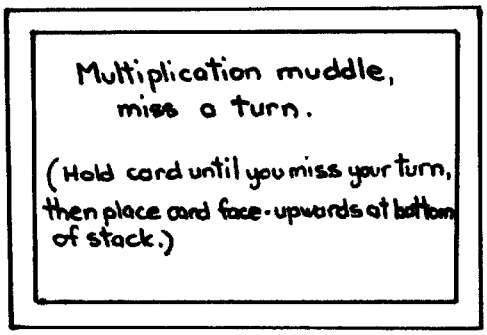

FIG. 1 shows a game board with a substantially planar surface. It shows the pathway all players follow, which starts at space 1 also marked start, and follows in numerical sequence to space 144. This is not necessarily the finish award, as will be detailed hereafter in Method of Play. The players travel along each row left to right, right to left, left to right, moving horizontally, following the red arrows, set as guides at the end of each row. Referring again to FIG. 1 some spaces are marked spaces, some are not. The marked spaces are detailed as follows: $.M.A.D. spaces as shown in FIG. 1. The thirty-six randomly placed $.M.A.D. spaces are associated with the $.M.A.D. cards as shown in FIG. 7. The letters $.M.A.D. are printed on the $.M.A.D. spaces on the game board and on the front of this exemplary card in FIG. 7, with instructions a player must follow on the back thereof When a player lands on a $.M.A.D. space they must pick up a $.M.A.D. card. The deck of $.M.A.D. cards contains thirty-six cards, half of which provide an opportunity of collecting money from the bank and the other half requiring payment of bills to the bank, all for a variety of predetermined reasons.

Figure 9A:
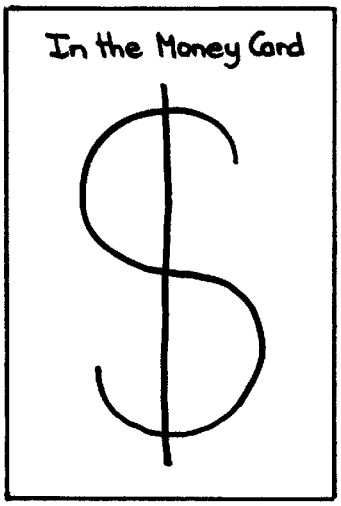
FIG. 9 shows a top and bottom plan view of an exemplary In the Money Card, used in accordance with this present invention.
Figure 9B:
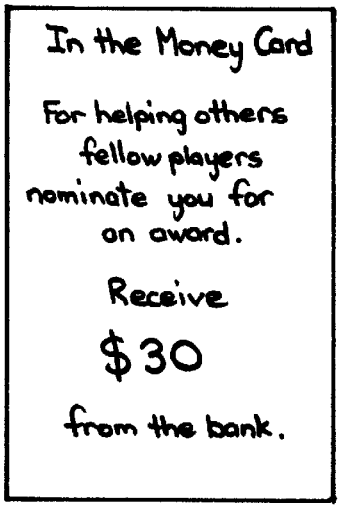

Twelve randomly placed spaces depict a black dollar sign, as shown in FIG. 1. These In the Money spaces are associated with the In the Money cards, as shown in FIG. 9. A black dollar sign is depicted on the front of this exemplary card with In the Money printed on the back thereof along with instructions a player must follow. The deck of In the Money cards contains twelve cards, all of which provide an opportunity of collecting money from the bank/other players for a variety of predetermined reasons.

Figure 10A:
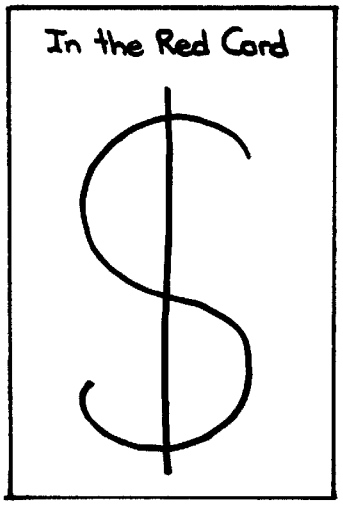
FIG. 10 shows a top and bottom plan view of an exemplary In the Red Card, used in accordance with this present invention.
Figure 10B:
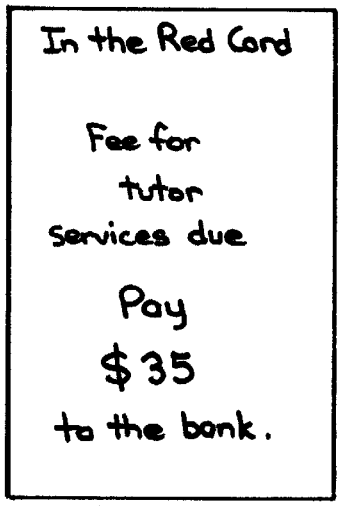

Twelve randomly placed spaces depict a red dollar sign, as shown in FIG. 1. These In the Red spaces are associated with the In the Red cards, as shown in FIG. 10. A red dollar sign is depicted on the front of this exemplary In the Red card, with In the Red printed on the back thereof along with instructions a player must follow. The deck of In the Red cards contains twelve cards, all of which require payment of various bills to the bank/other players for a variety of predetermined reasons.

Figure 8A:
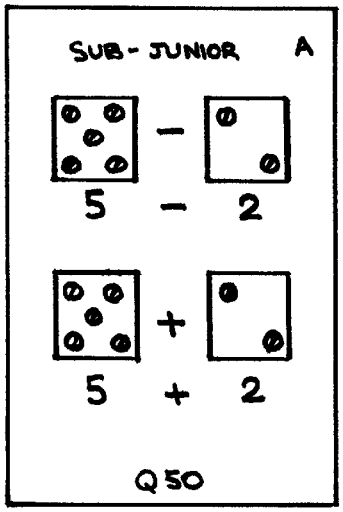
FIG. 8 shows a top and bottom plan view of an exemplary Question Card, used in accordance with this present invention.
Figure 8B:
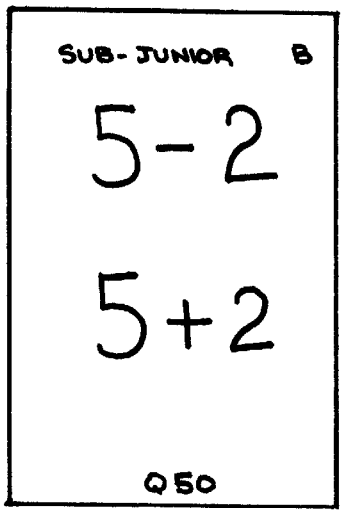

Thirty-six randomly placed spaces depict a blue question mark, as shown in FIG. 1. These Question spaces are associated with the Question cards, as shown in FIG. 8. The section Sub-Junior (A) is printed on the top and the question card number is printed down the bottom of this exemplary question card. On the front is also a subtraction and lower down an addition sum, with corresponding domino dots also representing each of the numbers of those sums. On the back of this exemplary question card is printed Sub-Junior (B) at the top and the question card number is printed on the bottom. There is also a subtraction and lower down an addition sum without the corresponding domino dots. No answers are printed on either side of the question cards. The Question cards are categorized into three sections. The Sub-Junior section consists of 72 cards with the section printed at the top of the (A) and (B) sides, a subtraction and addition sum on each side. The (A) side has corresponding domino dots under each number of each sum, the (B) side has the same mathematical sums minus the domino dots. The Junior section consists of 72 cards with the section printed at the top of the (A) and (B) sides. The (A) and (B) sides have four mathematical sums on each side in this order—subtraction, multiplication, addition and division. The multiplication sum corresponds with the division sum on all (A) sides of the 72 cards—on the (B) side they do not correspond. The Senior section consists of 72 cards with the section printed at the top of the (A) and (B) sides. The (A) and (B) sides have four mathematical sums on each side in this order—subtraction, multiplication, addition and division. The multiplication sum corresponds with the division sum on all (A) sides of the 72 cards—on the (B) side they do not correspond. In all three sections, on the bottom of each card, on the (A) and (B) sides, are printed the question card numbers. These question card numbers correlate with the mathematical sums in the Answer Booklet which is printed in section order: Sub-Junior, Junior and Senior with questions and answers correlating with the question card numbers found at the bottom of each side of each question card and printed in numerical sequence. All (A) side in the front half and (B) side in the back half of the Answer Booklet and every card's order of sums set out in the same order in the Answer Booklet and that is: subtraction, multiplication, addition and division. The Answer Booklet is not drawn as one familiar in the art would know that one must set the booklet out in an orderly fashion—this is mentioned to acknowledge the order on the Question Cards.

Figure 4:
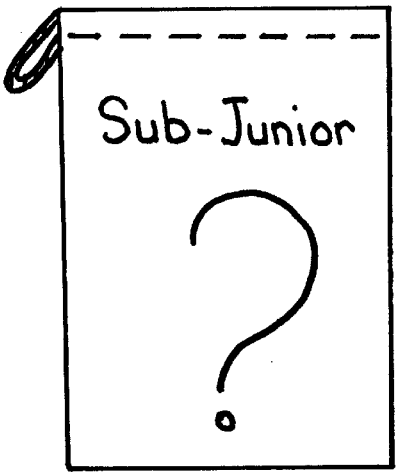
FIG. 4 is a plan view of an exemplary Question Bag, used in accordance with this present invention.

While on the subject of question cards which are as shown in FIG. 8, it would be pertinent to state all 72 cards in each section are shuffled and placed in the correlating exemplary Question Bags as shown in FIG. 4. There are two Question Bags for each of the three sections. The question bags are made of material sewn to form a bag with a drawstring at the top allowing for closure of the bags. These bags make it possible for players to reach in and randomly select a card not in view. Upon one side of each bag is printed the section and below a question mark all printing in blue to correlate with the blue question mark depicted on the Question spaces on the game board as in FIG. 1.

Twelve orderly spaced spaces depict an Award Ribbon at the end of each row as shown in FIG. 1. These Award Spaces are numbered consecutively in the order they appear from space 12 through to space 144 as in FIG. 1. They show an award ribbon, within its circular space is printed the order $1^{st}$ through to the $12^{th}$ also the monetary award allocated to each award ribbon which rises by tens from the $1^{st}$ being \$10 through to \$120 on the $12^{th}$ award ribbon as shown in FIG. 1.

Figure 5:
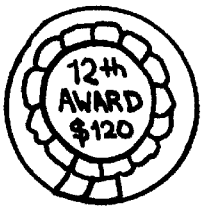
FIG. 5 is a plan view of an exemplary Award Ribbon, used in accordance with this present invention.

These twelve Award Spaces are associated with the Award Ribbons an exemplary of which is shown in FIG. 5. This figure depicts the $12^{th}$ Award Ribbon, showing the number of the award and the monetary award placed centrally on the ribbon. There are eight of each twelve award ribbons, as eight players can play the game simultaneously. In all, 96 Award Ribbons. Each award ribbon is designated a different colour and the colours correspond with the award ribbons on the game board as shown in FIG. 1.

Figure 11:
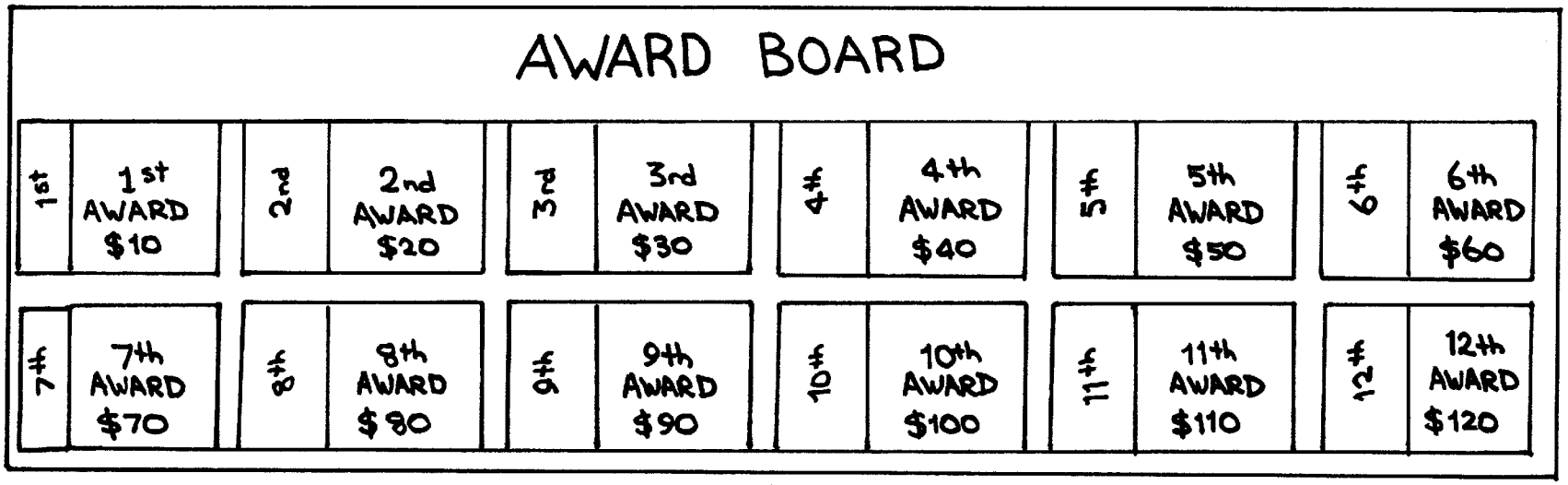
FIG. 11 is a plan view of an exemplary Award Board, used in accordance with this present invention.

While dealing with the subject of Award Ribbons as shown in FIG. 5. it would be pertinent to state here that these ribbons are associated with the Award Boards, an exemplary of which is shown in FIG. 11. There are eight Award Boards. This award board depicts a long-rectangular, planar card, which is divided into twelve equal divisions each numbered $1^{st}$ Award top row, through to $12^{th}$ Award on the bottom row. It is upon this board that a player places their Award Ribbons as they attain them, in its correlating space. The boards are placed in front of each player just above their personal Money Trays as in FIG. 12. Upon receiving an Award Ribbon, a player also receives the correlating monetary award from the bank.

Figure 13:
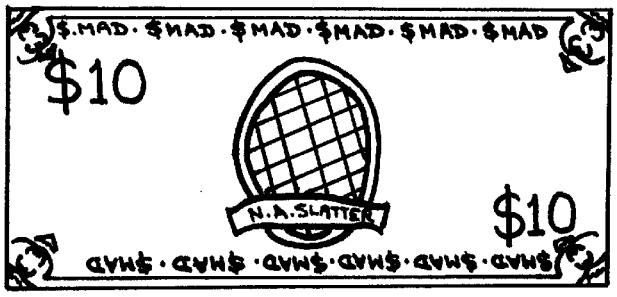
FIG. 13 is a plan view of exemplary Money, used in accordance with this present invention.

Having mentioned money, FIG. 13 shows an exemplary simulated ten dollar note. There are seven denominations as shown in FIG. 12 in this present invention, they are as follows: sixty-\$1 notes, sixty-\$5 notes, sixty-\$10 notes, sixty-\$20 notes, thirty-\$50 notes, thirty-\$100 notes and thirty-\$500 notes, each denomination a differing colour.

Figure 12:
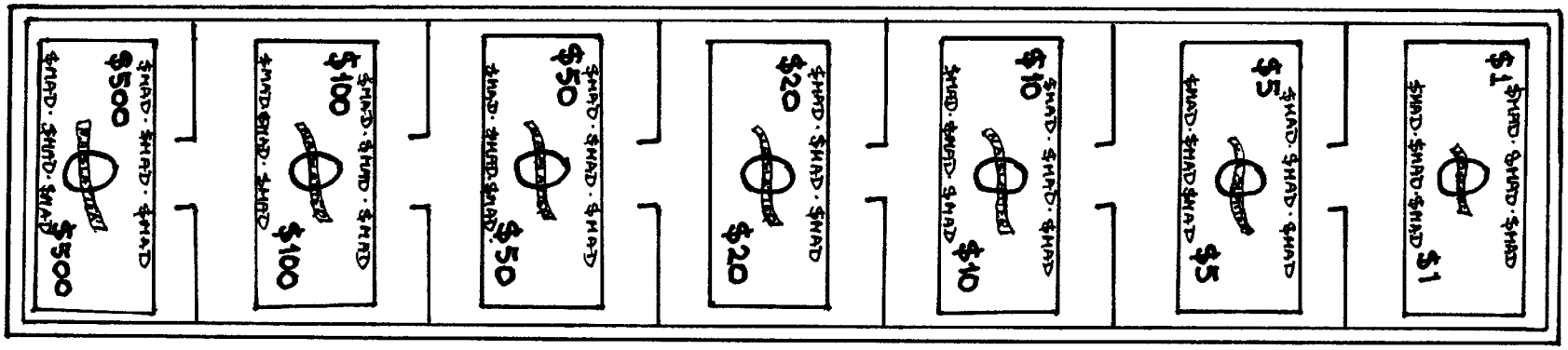
FIG. 12 is a plan view of an exemplary Money Tray containing money, used in accordance with this present invention.

Money is kept in personal money trays, an exemplary of which is shown in FIG. 12. There are nine money trays in this present invention. The money trays are vac-formed black trays moulded of plastic and formed to hold the seven denominations in a slightly sloping angle to make access easy for the players. One money tray is designated as the banker's tray, shown in FIG. 12. Eight are designated to be the players' personal money trays, to be placed directly under their Award Boards as in FIG. 11.

Figure 6:
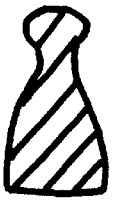
FIG. 6 is a perspective view of an exemplary Playing Piece, used in accordance with this present invention.

Before commencing a game, players must choose a playing piece, an exemplary of which is shown in FIG. 6. There are eight playing pieces—they are small, bottle-shaped, plastic pieces, each piece a differing solid colour.

Players' movement along the game board as in FIG. 1 takes four steps. This is markedly different to any Prior Art. These four steps use a combination of the components of the game in a set orderly fashion, they are: (1) A player randomly chooses a Question Card as in FIG. 8 from the relevant Question Bag as in FIG. 4. (2) They do the relevant mathematical sum (as designated by the Spinner as in FIG.

Figure 2:
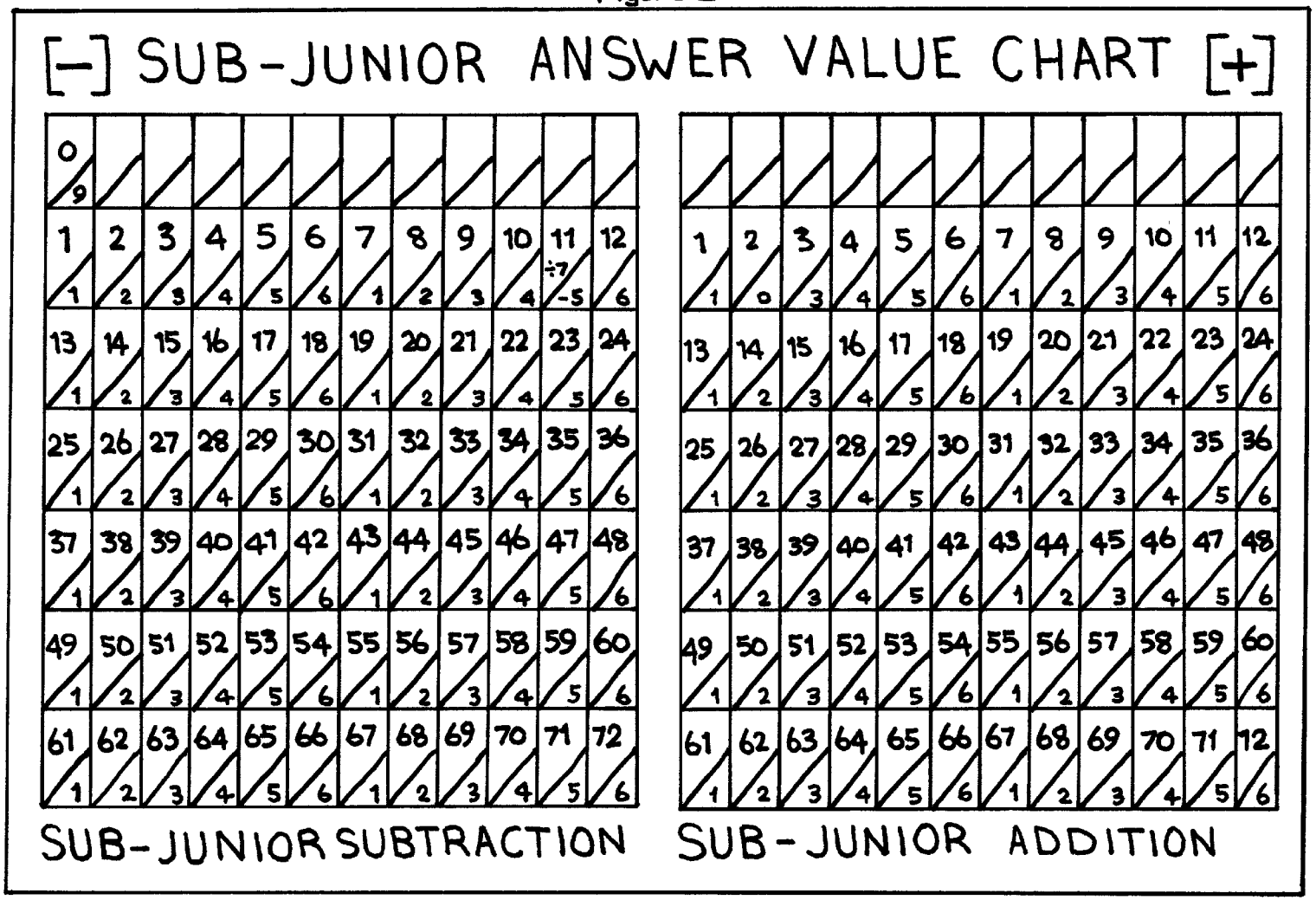
FIG. 2 is a plan view of an exemplary Answer Value Chart, used in accordance with this present invention.

3 at the commencement of the game), or follow the three learning styles to attain the correct answer. (3) They look up that answer on the relevant Answer Value Chart as shown in FIG. 2. The answer corresponds with a value—which is a predetermined number. (4) They move that number of spaces in numerical sequence on the game board as in FIG. 1, and collect that amount of money from the bank, as in FIG. 12.

Figure 3:
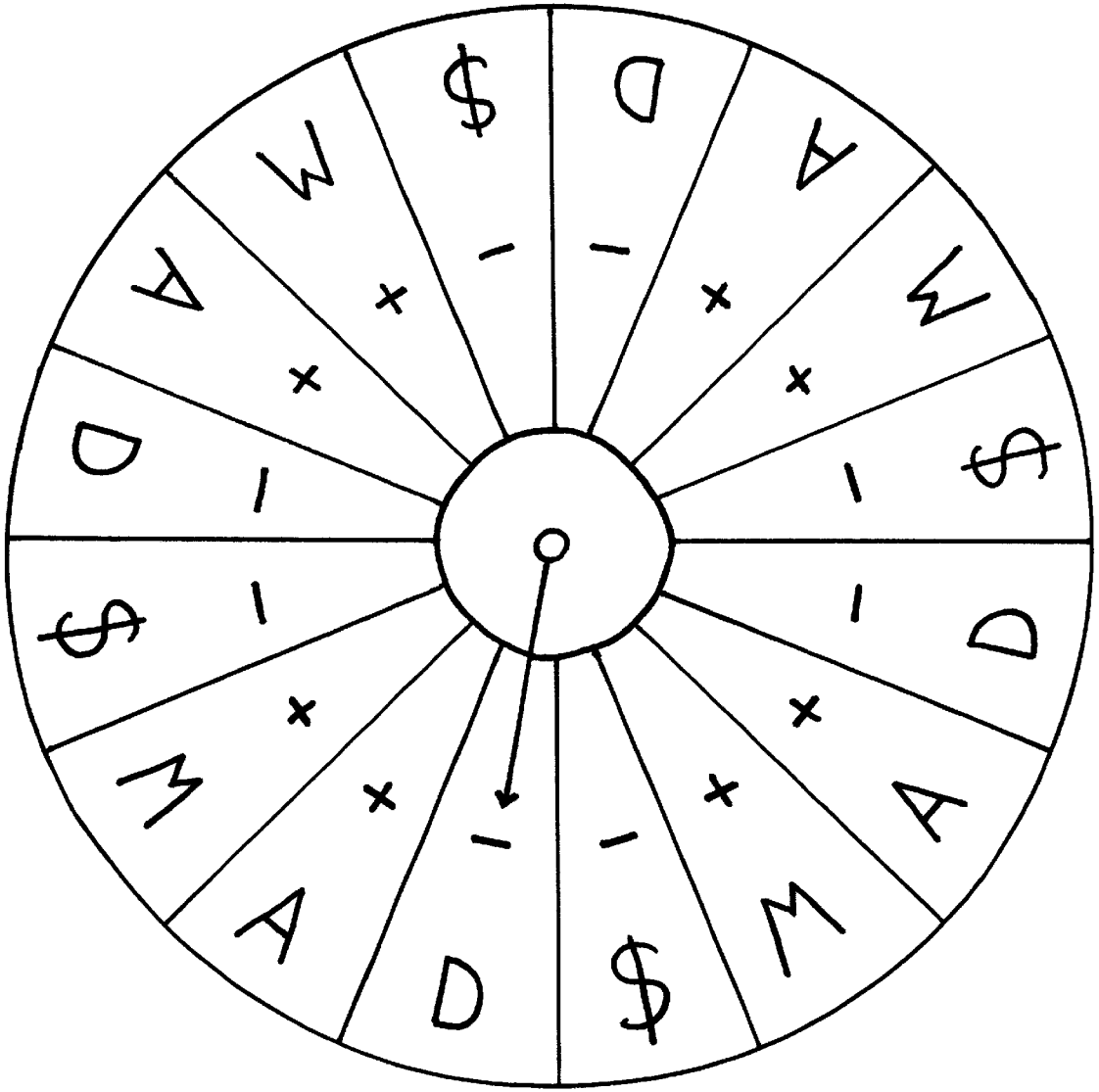
FIG. 3 is a plan view of the Spinner (a random selector device) used in accordance with this present invention.

The Spinner: this is a random selector device—the Spinner as shown in FIG. 3, is a component that has various uses throughout the game, as will be detailed hereafter in Method of Play. The spinner is a circular, planar, cardboard component. Centrally is placed a black plastic arrow, with an elongated shaft having an arrow tip or pointed end outwardly and centrally a knob and central piece that fits through an aperture in the centre of the circle that protrudes to the back, which is kept in position by way of a plastic disc—allowing for free circular movement of the arrow on the front playing surface. This playing surface, which has the arrow base placed centrally is circular, and has demarcations as follows: The circle is divided into sixteen equal radial, pie-shaped segments by radial lines. These sixteen segments are again divided into four similarly marked sets. The letters $.M.A.D. are marked on the four sets, one letter designated to each segment. Each letter has a mathematical symbol approximately halfway down each pie-segment towards the centre. Under the $., is a subtraction sign, under the M., is an addition sign, under the A., is an addition sign, under the D., is a subtraction sign. This indicia is repeated exactly in four sets of four to entirely fill the sixteen segments.

The Answer Value Charts, an exemplary of which is shown in FIG. 2. These are rectangular, planar, cardboard components. There are three Answer Value Charts, one for each section. The section is printed at the top of each one and the four formats are printed on the Junior and Senior's section the two formats on the Sub-Juniors. Each format in each section contains multiple small rectangles, in each rectangle is printed a large number, representing an answer to a sum, under which is a smaller number being the value.

Hitherto is the description of the preferred embodiments. It is in no way intended to limit the scope of this present invention to the exact construction and operation shown and described. The components in the drawings may (of necessity during manufacture) be modified slightly, or colours may vary due to availability, and cost considerations. Components may be provided with indicia, designating and depicting the name or trademark or have other similar indicia added thereupon the said components. A couple of components were not dealt with, not to limit in any way this present invention, but they are either generic as is the single die (used in a variable, or $2^{nd}$ embodiment of this present invention) which is six-sided with the numbers 1–6 designated to each of the six sides. The Answer Booklet, one familiar with the art would realize this is a necessary component. Mathematical sums, being known facts, cannot be protected, nor can the more difficult sums on the (B) side, previously not detailed but explained in Method Play, along with the three known learning styles, which are Audial, Visual and Kinesthetic-tactile learners. (Many familiar with this art know these facts.) Also twenty flat, plastic counters are provided for Sub-Junior players to correlate with the domino dots, as a maths aid. These too are known in the field, as counters are used in schools. Hereafter with this in mind is set out the Method of Play, these facts will be mentioned there, so as to give full understanding of the objectives of this new and improved invention.

METHOD OF PLAY

Components of the Game

1-Playing Board, 1-Rules Booklet, 1-Answer Booklet, 3-Answer Value Charts, 8-Playing Pieces, 12-In the Money Cards, 12-In the Red Cards, 36-$.M.A.D. Cards, 1-Generic Die, 96-Award Ribbons, 8-Award Boards, 1-Spinner, 8-Personal Money Trays, 72-Question Cards in each three sections, 6-Question Bags, and 20-Counters.

Money: 60-$1 notes, 60-$5 notes, 60-$10 notes, 60-$20 notes, 30-$50 notes, 30-$100 notes and 30-$500 notes. 1-Bank Tray.

The Object of the Game

To finish the game with the highest amount of money; to attempt to work out every answer, even if it means working them out on a scrap pad, on one's fingers, or mentally; to be the first player to receive the designated monetary award for the chosen Finish Award.

Preparation

To set up the game, lay the board as in FIG. 1 out flat for play; shuffle all cards as in FIGS. 7–10 and place them centrally to all players; put money into the correct money bays as in FIG. 12, shake up the questions in the respective question bags as in FIG. 4 and make sure the three empty question bags remain handy; set out the three Answer Value Charts as in FIG. 2, put out the Spinner as in FIG. 3; each player places their Award Boards as in FIG. 11 in front of them; players then choose their playing piece as in FIG. 6.

Money

Each player is given $200 distributed as follows: Five $1 notes, three $5 notes, one $10 note, one $20 note, one $50 note and one $100 note. Place in personal money trays as in FIG. 12.

Sections

The following recommendations are listed below, these may be changed to suit an individual's ability. It is best that players enjoy the game, they should not be struggling mentally with figures beyond their capabilities. So in reality, the section one is in does not have to be set by those below. Your own mathematical knowledge should be your guide. Adults who are playing with younger children should help them decide which section they'd be best playing in.

Three and four year olds may be quite capable of playing in the Sub-Junior section with its Domino Dot System, if they can count to twenty confidently, and by using the counters provided.

Sub-Junior

Five to eight year olds or Year one to Year three.

Junior

Eight to eleven year olds or Year three to Year six.

Senior

Eleven year olds to Adults or Year six through to Adults.

Each section has a slight overlap allowing for differing capabilities.

N.B. Before commencing play it is recommended that parents ensure they use the same method for subtracting and adding that is being taught by their child's/children's school teacher, so as to avoid confusion.

How to Play the Game

Players may allocate a banker or use the spinner as in FIG. 3 to allocate a banker, the banker will then be the player to whom the arrow points. The banker then spins. This spin will designate the format to be followed—that is, whether the entire game will be one of Subtraction, Multiplication, Addition or Division: (The arrow spins in the middle of the circular board, the board is divided into sixteen equal segments, these are marked as four lots of four, $.M.A.D. this indicates the Format, as the $. symbol means play will be Subtraction, M. means Multiplication, A. Addition and D. stands for Division. In the case of Sub-Juniors, they only ever play Addition or Subtraction, so their Format is also indicated by the arrow but they follow the Black Addition or Black Subtraction symbols which are marked halfway down each of the sixteen segments as in FIG. 3), this spin will also indicate the player who is to commence play.

Players must then choose a Finish Award on the board as in FIG. 1 that is any Award Space from the Second through to the Twelfth Award, depending on the length of time they wish to play. Every player must be sure of the section they are playing in by now. The player to commence has been indicated by the arrowhead, so now that player takes one question card as in FIG. 8 out of the appropriate question bag as in FIG. 4 and answers the question in the earlier indicated Format. Once the player has worked out the answer, (or followed the 3 steps to attain it, [see Note to Parents]), this is then checked by the player on their left from the Answer Booklet. The player then looks up that answer on the appropriate Answer Value Chart as in FIG. 2. The answer of the sum is in large numbers on the chart, and the value is the smaller number beneath it. The value is the number of spaces they move on the board, as in FIG. 1, the player also collects that amount of money from the bank as in FIG. 12. The first space on the board is number one, also marked "Start" as in FIG. 1. After the first player has finished all indicated play, the player on the left then takes a question out of the appropriate question bag as in FIG. 4 and so on, until everyone reaches the nominated Finish Award.

AN IMPORTANT NOTE: As each Question Card is used, it goes into the empty, correlating question bag. When the bag is empty, players then use the recently filled one. This is important as it enables a greater variety of mathematical sums to be covered.

How to Finish the Game

The first player to land on, or pass through the nominated Finish Award is regarded as the first to reach the Finish Award. This is the only player entitled to answer the Award questions and receive the appropriate Award as in FIG. 5 and Award Money for that award space, plus the bonus for finishing first, which is $50 for the First Award through to the Sixth Award, and $100 for the Seventh through to the Twelfth Award. The player from that point on, while waiting for all other players to reach the Finish Award, answers questions and receives the correct money each time it is their turn but does not move. This is to continue; each player does this until the last player has reached the Finish Award.

The Winner

Now every player can tally up all their money; the player with the highest amount is the WINNER. In the case of a tie, the player with the most Awards as in FIG. 5 on their Award Board as in FIG. 11 is declared the WINNER.

Information on Components

The Board: as in FIG. 1. A player moves horizontally left to right, right to left, left to right, and so on along a flat board, which has twelve spaces to each twelve rows, 144 spaces in all. Each space is numbered 1 through to 144. Some spaces indicate certain directions; (SEE INFORMATION ON MARKED SPACES).

The Answer Booklet: This is given to the player on the left of the person who is indicated to move first. The Answer Booklet then gets passed around to the person on the left of the player whose turn it is. It is the responsibility of this person to check the answer given. The Booklet contains every answer that is on every question card and is placed under the number which is found at the bottom of every question card. This is known as the Question Card Number. It is of course set out in three sections: Sub-Junior, Junior and Senior. They are also set out in this order, Subtraction, Multiplication, Addition and Division. Of course if it is agreeable to all players that the eldest and most capable player be the judge of all answers that are given, that will suffice, otherwise if in doubt, use the Answer Booklet.

The Answer Value Charts: as in FIG. 2. There are three Answer Value Charts, Sub-Junior, Junior and Senior. Once a player has worked out a given sum, the answer of that sum is looked up on the appropriate Answer Value Chart; the corresponding Value, (which is the number in smaller print underneath) is the amount of money received from the Bank and the number of spaces moved.

The Spinner: as in FIG. 3. This is a circular board with a movable black arrow which is in a circle with sixteen segments. These are marked as four lots of four $.M.A.D. This indicates the format, as the $. symbol means play will be Subtraction, M. means Multiplication, A. Addition and D. stands for Division. In the case of Sub-Junior they only ever play Addition or Subtraction, so their Format is also indicated at the beginning of the game by the arrow, but they follow the Black Addition or Black Subtraction symbols which are marked halfway down each of the sixteen segments.

The Question Bags: as in FIG. 4. These are drawstring bags made of cloth. The question section is printed in blue on each bag, that is Sub-Junior, Junior and Senior and a blue question mark is printed on each bag.

The Award Ribbons: as in FIG. 5. There are eight of each awards, number one through to number twelve. In all there are a total of 96 Award Ribbons. Each of the twelve are a different colour and these are put on the players' Award Boards as they attain them. (The $1^{st}$, $2^{nd}$ and $3^{rd}$ Awards each have an extra Award.)

The Playing Pieces: Altogether there are eight Playing Pieces as in FIG. 6, all a different colour. Players must choose their playing piece before commencing the game.

Information on Marked Spaces $.M.A.D. Spaces: as in FIG. 1. Upon landing on a $.M.A.D. space, a player picks up a $.M.A.D. card as in FIG. 7. and follows the instructions thereon. The player then places the card face-upwards on the bottom of the $.M.A.D. stack of cards.

Question Spaces: as in FIG. 1 are marked with a blue question mark. When a player lands on this space they must spin the spinner as in FIG. 3, then take one question card as in FIG. 8 from the appropriate question bag as in FIG. 4, and do the sum that is indicated by the arrow head, for example if they were to spin and land on a $ symbol, they must do the subtraction sum that is on the question card. Sub-Juniors follow the black indication they spin which will be either subtraction or addition. Every player receives $10 for answering, but note well, they do not move at all.

In the Money Spaces: as in FIG. 1. These are indicated by a large Black $ sign. When the player lands in this space they pick up an In the Money card as in FIG. 9 marked with a black dollar sign and they follow the instructions, then place the card face-upwards on the bottom of the correct stack.

In the Red Spaces: as in FIG. 1. These are indicated by a large Red $ sign. The same applies as above, only players use the cards marked with a red dollar sign as in FIG. 10.

Award Spaces: as in FIG. 1. Upon landing on an Award Space, a player takes a question card (FIG. 8) from the appropriate bag (FIG. 4) and once all the questions on that card are answered the player receives the amount of money showing on that award space. They do not move, but they receive the appropriate award (FIG. 5) and place it on their Award Board as in FIG. 11. (Seniors and Juniors answer 4 questions, Sub-Juniors 2.)

Miscellaneous Rules and Information

Two or more players may be on the same space at any given time and are not penalised in any way. Each player does what that space indicates as they land there.

A player must have finished all indicated moves before the next player can take their turn.

For every space a player moves forward they receive one dollar.

When a player moves backwards, they don't receive any money (FIG. 13), but upon their next turn they move forwards with normal play, receiving money, picking up cards etc. Note well, if the player retracing spaces lands on an Award Space (FIG. 1) they may substitute their next turn to answer the four or two questions, only if they do not already have that award (FIG. 5) on their Award Board (FIG. 11).

The player nominated to be the Banker is responsible for collecting or paying all money (FIG. 13) to players and as indicated on the In the Money as in FIG. 9, In the Red as in FIG. 10, and $.M.A.D. cards as in FIG. 7, unless otherwise specified.

The game may be played by no less than two, no more than eight players. Five year olds to adults are the recommended ages, but if a child say, of three or four, is capable of playing the Sub-Junior Domino Dot system, that is certainly allowable. If a child can manage a higher level than the recommended age section, that also is quite acceptable.

Green is used for Seniors, Red for Juniors, Blue for Sub-Juniors where possible throughout the game.

All players are on an equal value system because of the Answer Value Charts. Each format of each section has seventy-two sums, and these answers have a value totalling 250. Division is the only section where Senior and Junior Values total 252. With this in mind, the Sub-Junior Answer Value Chart (FIG. 2) is modified to allow them to attain the two extra points when Seniors and Juniors are playing in the division format. On their Subtraction Chart, which is what they play when Seniors and Juniors are playing division, the answer of a given sum which is eleven has the value of seven when others are playing division and only five when playing subtraction. The Answer Value Chart has the two values under Subtraction—Answer eleven, one marked with division and the other with subtraction (FIG. 2). Even though all players are on an equal value system because of the Answer Value Charts (FIG. 2) chance has a large part to play in the game.

Remember to change smaller bank notes for larger, whenever too many are accumulated in your personal trays (FIG. 12), this helps the bank to run more efficiently.

A player may borrow money from the bank (FIG. 12) if bankruptcy occurs, but they must give the banker a signed note stating the amount borrowed, and they must pay that amount back as soon as possible.

When answering multiplication and division questions, players do have the answer on the (A) Section cards, however it cannot be emphasised enough, that learning by repetition rather than becoming discouraged, is the aim of the game.

A player may only land on an Award space or any other space (FIG. 1), not including the nominated Finish Award, by the value given (plus die throw if applicable—see Variables of the Game).

A player does not receive Awards (FIG. 5), nor Award money because they passed an Award or any other marked space (FIG. 1) during their turn. Note well, on the Finish Award this does not apply to the first person, they receive that Award (FIG. 5) and Award Money, and they and the following players must stop there no matter what answer value (plus die throw if applicable) they attain.

Calculators should not be used, as this detracts from the whole concept of the game. If a child cannot deduce the correct answer, they are not penalised in any way. They follow the 3 steps (see Note to Parents) then they move as usual.

Included in this game is a slightly more difficult section, the (B) Section of Question Cards (FIG. 8 [back]), these are used in exactly the same way as the (A) Section Cards (FIG. 8 [front]). You will notice in the (B) Section, the division question at the bottom of the card is not the reverse of the multiplication question above, in (A) Section they are. Also, the Domino Dot system is not used on the (B) Section of Sub-Junior cards. The (B) Section is to be used once players are finding the (A) Section too easy.

The same Answer Value Charts (FIG. 2) are used for each section.

All players will still be on equal terms even if they are using (A) Section and (B) Section cards simultaneously (FIG. 8).

Variables or Other Embodiments of the Game

1. A variable of the game can be played with a generic die, which is six-sided with a number on each side, these numbers being one to six. Once a player has taken a Question Card and worked out the answer, they add the value from the chart to the throw of the die. This is the number of spaces they move and the amount of money they receive from the bank. This of course applies to each player.

2. Another variable of the game is for players that are very competent. They may decide to set a time limit of their choice for answering. They may only allow answers to be worked out mentally, and may not allow a move if the answer is incorrect. If it is found that this discourages any players, or on the other hand the enjoyment of the game is diminished in any way because of this form of play, it would be wise to follow the normal rules.

3. A third variable of the game is: players spin the spinner before their turn, and they do the sum in the indicated format, rather than the normal way which is for the entire game to be played in the one Format, e.g. Subtraction. So each turn would allow for variance in formats. A Note to Parents: Parents will find the game valuable. Repetition in the game (especially where Times Tables are concerned) will enhance your child's/children's mathematical skills. Parents that know the areas of weakness their child/children may have, may suggest that that particular format be played more often. For a younger child playing the game, a parent might find this a great way to show the child how to e.g. apply the rules of subtraction or addition. The game may also help parents find areas of weakness that were previously unknown. For those parents that enjoy interacting with their children, and helping them learn, this game will provide the perfect opportunity, in a positive manner.

N.B. Players may do sums mentally, on a scrap pad, or by using their fingers. If, after two or three serious attempts they are still struggling:

1. Show them the sum in the Answer Booklet—(VISUAL).

2. They write the sum, then you show them how to do it—(KINESTHETIC-TACTILE).

3. Say the entire sum out loud—they hear it (AUDITORY). These steps cover the three known learning styles. Your verbal praise upon completion will mean more to them than any awards the game can offer.

Closing Note

This mathematical board game is designed to provide consolidation of the four basic mathematical formats children are taught at school. They need to know these before they can grasp more advanced mathematical concepts. It incorporates an emphasis on fun as these skills are being learnt and revised. The game is useful as an interactive tool, encouraging social skills in players, such as turn taking. Through novel and exciting ways it uses many different, yet positive aspects, to keep the player entertained. For example, Awards can be achieved, and the value and handling of money is another area they learn about and receive for their efforts. Chance also plays a large part in the game due to various components. A great bonus is the design of the Answer Value Charts; they allow all age groups to play together, yet have a chance to attain equal values. Parents will appreciate the aspect of being able to choose the length of time they wish to spend playing with their child/children. Another positive aspect not to be overlooked is that every player either deduces the correct answer, or follows the three steps to attain the answer. This enables them to gain confidence in their mathematical prowess.

For those skilled in art, the foregoing description of this particularly inventive mathematical, yet entertaining, board game, aimed at the specific needs for those mathematically-challenged in the basics of maths, is advantageously provided for in this present invention. The subject matter or theme of the board game may vary, and may be based on one of many categories of subject matter. The "Basic Mathematical" theme of the exemplary embodiment of the game described hitherto, is primarily for purposes of illustration of the basic features of the game only. The structural components of the game may be provided of conventional materials for board games, using conventional manufacturing processes, that is not to limit it only to this media. Moreover, the features, advantages and method of play described above, are believed to be set forth in sufficient detail, as to enable those skilled in the art, to practice the invention. Still further, various substitutions and modifications may be made, without departing from the scope and spirit of the appended claims.

What is claimed is:

1. A method of playing an educational game comprising the acts of:

providing a game display presenting a playing surface having a travel path divided into spaces;

providing a marker to each player to indicate their position on the travel path;

selecting a section from one of either Sub-junior, Junior or Senior sections in which each player will play;

actuation of a random selector device for selecting a format being either Subtraction, Multiplication, Addition or Division choosing a question card from a set of question cards according to the section selected for that player;

answering a question on the question card corresponding to the format selected by the random selector device;

correlating the correct answer with the number of spaces the player can move, indicated by the answer value designator;

repositioning the answering players marker according to the value indicated by the answer value designator, whereby the repositioning of the marker onto a space with indicia thereupon will require the player to perform the activity indicated thereby;

providing a reward scheme corresponding to the answering of questions and various activities of the game; and successively repeating said steps until all players markers have reached a pre-selected finishing space.

2. A method of playing an educational game according to claim 1, wherein the random selector device is a six sided generic die and the value from the throw of the die is added to a value from an answer value chart in order to move a number of spaces.

3. A method of playing an educational game according to claim 1, wherein a time limit is set for answering and the player is allowed to work out answers mentally only, furthermore the player may not move if answered incorrectly.

4. A method of playing an educational game according to claim 1, wherein a spinner is spun before each player's turn to allow a variance in format through out the entire game.

* * * * *